United States Patent [19]

Cohen

[11] Patent Number: 4,810,952

[45] Date of Patent: Mar. 7, 1989

[54] CIRCUITRY AND METHOD FOR CONTROLLING POWER TO FASTENER MACHINE SOLENOID

[75] Inventor: Burton E. Cohen, Dix Hills, N.Y.

[73] Assignee: Swingline Inc., Long Island City, N.Y.

[21] Appl. No.: 880,232

[22] Filed: Jun. 30, 1986

[51] Int. Cl.[4] ..... G05F 5/02

[52] U.S. Cl. ..... 323/300; 323/325; 323/326; 361/160; 361/206

[58] Field of Search ..... 323/241, 242, 299, 300, 323/322, 325, 326; 361/152, 153, 156, 160, 205, 206

[56] References Cited

U.S. PATENT DOCUMENTS

| | | | |
|---|---|---|---|
| 3,935,530 | 1/1976 | Tanaka et al. | 323/300 |
| 4,047,096 | 9/1977 | Madewell | 323/300 |
| 4,311,955 | 1/1982 | Murakami | 323/300 |
| 4,353,112 | 10/1982 | Rietveld et al. | 323/299 X |
| 4,425,611 | 1/1984 | Easter | 323/299 X |
| 4,468,569 | 8/1984 | Norris | 323/299 X |
| 4,490,771 | 12/1984 | Huber et al. | 323/242 X |
| 4,500,938 | 2/1985 | Dulin | 361/152 X |

*Primary Examiner*—Patrick R. Salce
*Assistant Examiner*—Emanuel Todd Voeltz
*Attorney, Agent, or Firm*—Pennie & Edmonds

[57] ABSTRACT

A method and apparatus for controlling power delivered to a fastening machine solenoid comprises a half wave rectifier, a filter network, an adjustable frequency generator and a pulse conditioning circuit. The frequency of the frequency generator is varied in accordance with fluctuations in peak AC line voltage and is input to driving circuitry which engages a solenoid at a predetermined time and for a specific amount of time. By increasing or decreasing the solenoids on time in accordance with power line voltage fluctuations, a pulse of constant power will be received by the solenoid, regardless of fluctuations in power line voltage.

16 Claims, 2 Drawing Sheets

CIRCUITRY AND METHOD FOR CONTROLLING POWER TO FASTENER MACHINE SOLENOID

BACKGROUND OF THE INVENTION

This invention relates generally to power compensation circuits, and more specifically to a method and apparatus for supplying a controlled clock pulse to driving circuitry to provide constant power to a fastening solenoid regardless of fluctuations in power line voltage.

It has been recognized for some time that typical B 115 VAC lines often fluctuate in voltage. Unfortunately, such fluctuations may also provide equally fluctuating power to certain electrical devices resulting in decreased efficiency, poor performance, damage to the device and other detrimental effects. Although devices which perform voltage compensation such as voltage clipping devices do exist in the art, such devices suffer in that they do not provide controlled power to devices which do not represent purely resistive loads.

A further deficiency of prior art devices is a failure to provide a controlled amount of power for a relatively short predetermined amount of time to an electrical device such as an engaging solenoid of an electric fastening machine in view of power line fluctuations. More specifically, electric fastening machines generally include a fastening solenoid which is provided with a pulse of short duration to engage the solenoid and therefore fasten material. As a result, devices have been provided which produce a pulse comprising a portion of the positive half of the AC line voltage sine wave. More particularly, device SW-197.2 manufactured by Swingline Inc. will provide a pulse of the 115 VAC line to the engaging solenoid, said pulse starting when a digital counter reaches its sixteenth count after the 115 VAC sinusoidal wave reaches a positive going zero crossing. This pulse has a magnitude approximately equal to or proportional to the corresponding portion of the sine wave. This pulse may exist for a duration corresponding to, illustratively, 70° to 110° of the 115 VAC line, where the positive going zero crossing represents 0°. However, since the 16 bit counter is driven by a clock of constant frequency, this firing pulse will exist from 70° to 110° regardless of the magnitude of the input line voltage. An increase in line voltage magnitude will provide a pulse from 70° to 110°, but at a higher voltage and therefore increased power. Such a pulse of increased power may result in the engaging solenoid engaging in too forceful a manner or short circuiting from overload. Similarly, a decrease in line voltage magnitude will provide a pulse from 70° to 110° but at a lower voltage. Such a pulse of decreased power may result in a supply of inadequate power to the engaging solenoid, resulting in jamming or insufficiently fastened materials.

SUMMARY OF THE INVENTION

The present invention comprises a power compensating clock conditioning circuit wherein the frequency of an output clock is a function of the magnitude of the AC peak line voltage and the associated use of such circuit.

The circuit comprises a half wave rectifier, a filter network, an adjustable sawtooth waveform generator and a pulse conditioning circuit. The half wave rectifier and filter serve to provide an essentially DC voltage level proportional to the magnitude of the 115 VAC line voltage sine wave. Fluctuations in the peak AC line voltage will cause corresponding fluctuations in the DC voltage level output by the half wave rectifier and filter network. This DC voltage level, $V_{bias}$, is input to an adjustable sawtooth waveform generator and pulse conditioning circuit. The sawtooth waveform generator generates a waveform having a frequency which varies according to the magnitude of the AC line voltage. The pulse conditioning circuit provides clear pulses of the same frequency as the sawtooth waveform. The output of the pulse conditioning circuit represents a clock having a frequency decreasing as the peak AC line voltage increases, and increasing as the peak AC line voltage decreases.

Advantageously, such a conditioned clock pulse may be used to drive circuitry to engage a fastening solenoid for an increased length of time if the AC line peak voltage decreases and for a decreased length of time if the AC line peak voltage increases. Such circuitry may comprise device SW-197.2 manufactured by Swingline Inc., in which case the conditioned clock pulse drives a five bit digital counter.

Accordingly, it is a principle object of the present invention to provide new and improved circuitry for fastening devices.

A further object is to provide a clock conditioning circuit to increase the efficiency of fastening devices.

A further object is to provide a circuit which compensates for line voltage variations.

Another object is to provide a method and apparatus to control the solenoid on time of a solenoid actuated fastening machine.

A still further object is to provide a system which delivers a pulse of constant power to an electrical device, regardless of line voltage variation.

BRIEF DESCRIPTION OF THE DRAWINGS

These and other objects, features and advantages of the invention will become more readily apparent with reference to the following description of the invention in which.

DETAILED DESCRIPTION OF THE INVENTION

Figure 1:
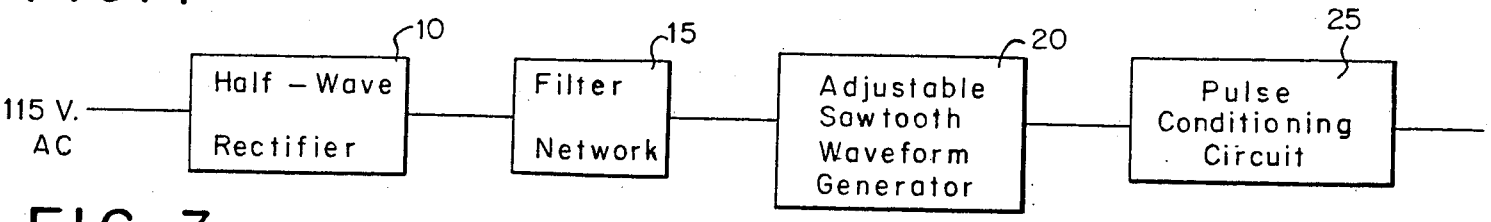
FIG. 1 illustrates, in block diagram form, the clock conditioning circuit of the present invention.

Referring first to FIG. 1, there is shown in block diagram form a first embodiment of the power compensating clock conditioning circuit of the present invention comprising a half-wave rectifier 10, filter network 15, adjustable sawtooth waveform generator 20 and pulse conditioning circuit 25.

Figure 2:
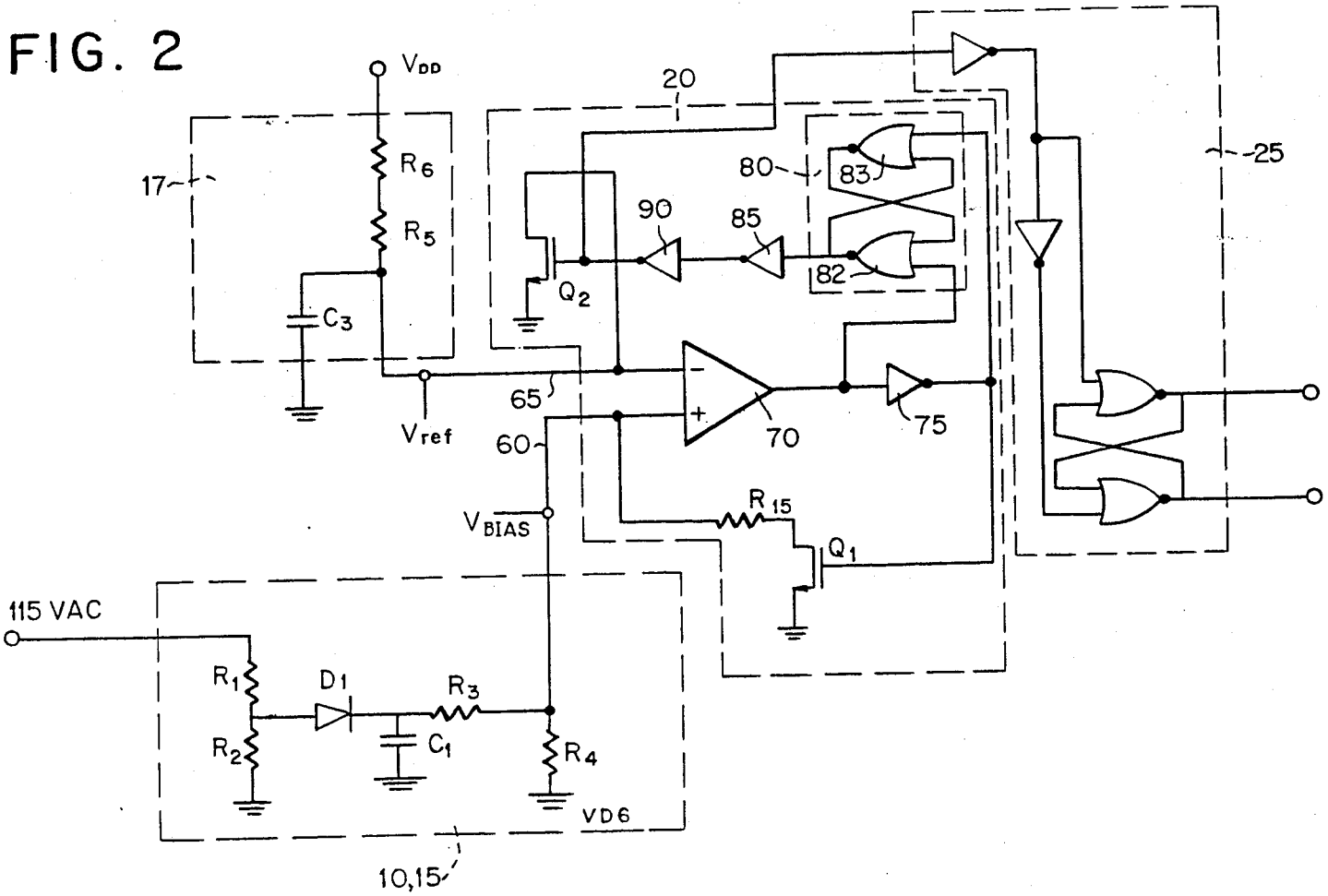
FIG. 2 illustrates, in detailed schematic form, the clock conditioning circuit.

Referring now to FIGS. 1 and 2, half wave rectifier 10 may comprise a resistor $R_1$, $R_2$ and a diode $D_1$ connected in series. The 115 VAC line is input to this rectifier, providing an output of only the positive portion of the input sine wave. Filter network 15 may comprise a resistor $R_4$ and capacitor $C_1$ combination to ground as well as a series resistor $R_3$ to the input of adjustable sawtooth waveform generator 20. Filter network 15 essentially serves to smooth the output of half wave rectifier 10 and provide its own output of D.C. voltage, $V_{bias}$.

Adjustable sawtooth waveform generator 20 and pulse conditioning circuit 25 are depicted in more detail in FIG. 2. The $V_{bias}$ voltage on line 60 represents the essentially DC voltage output by the combination of half wave rectifier 10 and filter network 15 of FIG. 1. Upon the occurrence of any fluctuations in line voltage input to rectifier 10 and filter 15, an output will be provided on line 60 with a corresponding fluctuation. In other words, if the AC peak line voltage increases, a corresponding increase will be noted in $V_{bias}$ on line 60. Similarly, if the AC peak line voltage decreases, a corresponding decrease will be noted in $V_{bias}$ on line 60. $V_{ref}$ is produced on line 65 by an external R-C network 17 comprising resistors R5 and R6 connected to a supply voltage, $V_{dd}$, and timing capacitor $C_3$ connected to ground.

The waveform on line 65 represents a sawtooth which charges to $V_{dd}$ exponentially and returns to ground with a comparatively small fall time. The voltage level at which the waveform on line 65 switches from a positive going signal to a negative going signal, and thus the frequency, will depend upon the voltage level on line 60. More specifically, any capacitor to ground located on line 65, whether internal or external will always be charging towards $V_D$, which is fixed in value and independent of the AC line voltage. This charging voltage is compared to the voltage $V_{bias}$ on line 60 by comparator 70. Since the voltage $V_{bias}$ on line 60 rises as the peak value of the AC line voltage rises, the time for the voltage on timing capacitor $C_3$ to reach the voltage $V_{bias}$ on line 60 will increase as the AC line peak voltage increases. Similarly, the time for the voltage on timing capacitor $C_3$ to reach the voltage $V_{bias}$ on line 60 will decrease as the AC line peak voltage decreases. However, when the voltage across timing capacitor $C_3$ reaches $V_{bias}$ on line 60, timing capacitor $C_3$ will be discharged to ground and a new cycle will begin. It follows that a smaller timing capacitor charge time results in a higher clock rate and a larger timing capacitor charge time results in a lower clock rate. Therefore, the clock frequency increases as the AC peak voltage is lowered and decreases as the peak line voltage is increased. This variable clock frequency which is a function of the peak line voltage may be utilized to replace the standard constant frequency clock in driving circuitry which requires only a portion of the AC line voltage sine wave to energize a device. Such a device illustratively is device SW-197.2 manufactured by SwinglineInc. By replacing the constant frequency clock of SW-197.2 with the present invention, a silicon controlled rectifier (SCR) may be caused to fire at various different phase angles depending on the line voltage, thus delivering a firing pulse of constant power to the solenoid which causes the fastening device to actuate, regardless of power line fluctuations.

Referring back to the circuit in FIG. 2, when the voltage on line 65 becomes equal to the voltage on line 60, the output of comparator 70 switches from a high level to a low level causing the output of inverter 75 to become high and turning transistor $Q_1$ on. A voltage divider is set up between line 60 and the input of comparator 70 via resistors $R_3$, $R_4$ and $R_{15}$. This causes the voltage on line 60 to drop significantly. The high output out of inverter 75 causes flip flop 80 comprising nor gates 82, 83 to set and the output of nor gate 82 to go high. The output of nor gate 82 is buffered by inverters 85 and 90 and applied to transistor $Q_2$, turning $Q_2$ on. The timing capacitor $C_3$ on line 65 is discharged toward ground rapidly by transistor $Q_2$. When the timing capacitor $C_3$ on line 65 is discharged to the new voltage on line 60, comparator 70 switches from a low level to a high level. The new lower voltage on line 60 insures that timing capacitor $C_3$ will discharge significantly before comparator 70 switches back to its former state. At this time, transistor $Q_1$ cuts off and nor gate 82 output of flip flop 80 becomes low. This low signal is delayed by inverter pair 85, 90 before cutting of transistor $Q_2$ to insure that the timing capacitor $C_3$ on line 65 is completely discharged to ground. At this time, the circuit is returned to its original state and a new cycle begins.

Illustrative values for resistors, capacitors and diodes are as follows:

| Resistors (ohms) | Capacitors | Diodes |
|---|---|---|
| $R_1$ = 100 k | $C_1$ = 22 uF | $D_1$ = 1N4005 |
| $R_2$ = 3.3 k | $C_3$ = 470 pF | |
| $R_3$ = chip resistor | | |
| $R_4$ = chip resistor | | |
| $R_5$ = 330k | | |
| $R_6$ = 100k | | |
| $R_{15}$ = chip resistor | | |

$R_3$, $R_4$ and $R_{15}$ are integrated circuit resistors of nominal value.

Figure 3:
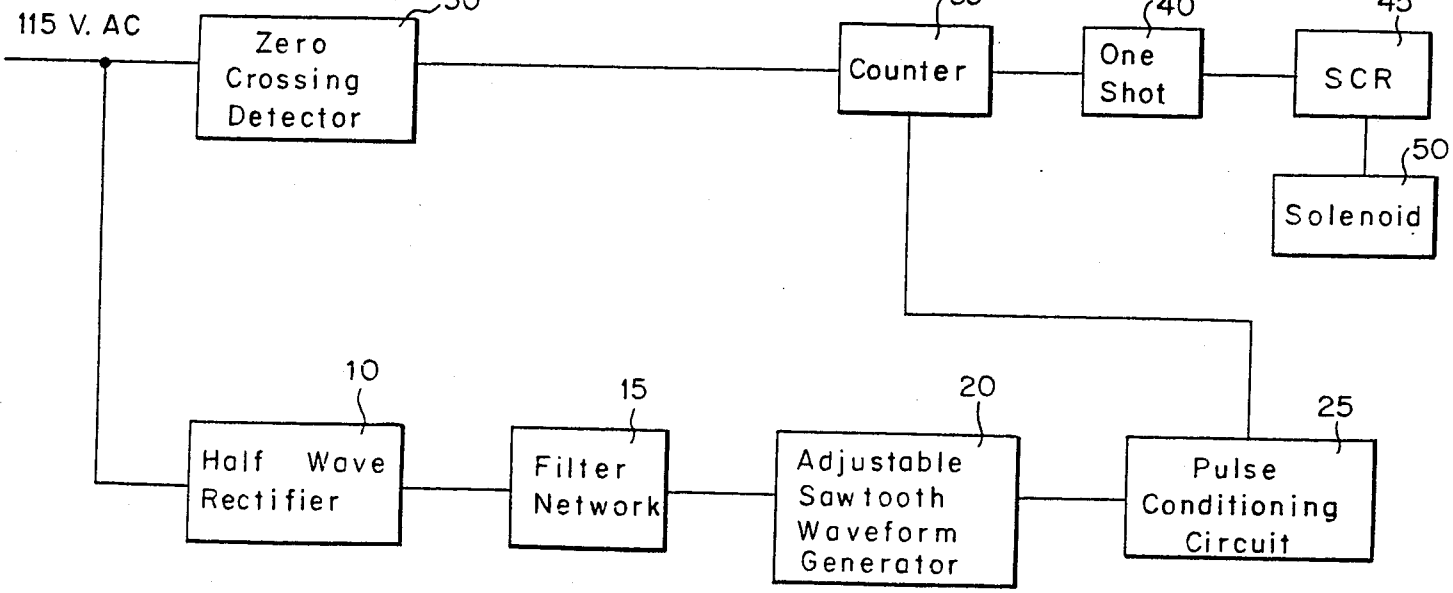
FIG. 3 illustrates, in block diagram form, a use of the clock conditioning circuit to regulate power applied to the solenoid of an electric fastening device.

Referring to FIG. 3, there is shown in block diagram form, a use of the power compensating clock conditioning circuit of the present invention to provide an adjustable clock rate to a phase delay network which engages a solenoid for a variable predetermined period of time after the positive going zero crossing of the 115 VAC line voltage. Half wave rectifier 10, filter network 15, adjustable sawtooth waveform generator 20 and pulse conditioning circuit 25 function as previously discussed in conjunction with FIGS. 1 and 2. In addition, zero crossing detector 30 detects the positive going zero voltage crossing of the 115 VAC line. Zero crossing detector 30 may comprise a Schmitt trigger, a flip flop and a one-shot. Once such crossing is detected counter 35 which may illustratively be a 0–16 digital counter comprising five flip flops, will receive a control pulse and start initiating a 16 digit count. The circuit described in conjunction with FIGS. 1 and 2 will provide the variable frequency clock input to counter 35. Since the clock conditioning circuit of FIGS. 1 and 2 will provide an increase in clock frequency to counter 35 when the AC line voltage decreases, counter 35 will reach its sixteenth count in less time. Once counter 35 reaches its sixteenth count, it causes one shot 40 to fire, thus providing silicon controlled rectifier (SCR) 45 with a firing pulse which has a specific phase angle in relation to the AC line voltage. This phase angle will be lower for a decrease in AC line voltage and higher for an increase in AC line voltage. This firing pulse is applied to the gate terminal of SCR 45 for a predetermined length of time which is less than one half cycle of the 60 cycle 115 VAC line, thus permitting the SCR to couple its 115 VAC input to the solenoid for a period of time corresponding to less than one half cycle of the 115 VAC line. Similarly, the clock conditioning circuit of FIGS. 1 and 2 will provide a decrease in clock frequency to counter 35 when the AC line voltage increases, thereby causing counter 35 to reach its sixteenth count in greater time, and subsequently causing solenoid 50 to engage for a decreased period of time.

In operation, the power received by solenoid 50 will be essentially identical for a decrease or an increase in AC line voltage. An increase in AC line voltage will cause a decrease in clock frequency which results in a shorter solenoid on time. Similarly, a decrease in AC line voltage will cause an increase in clock frequency which results in a longer solenoid on time.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. In the use of an electric fastening machine wherein a clock driven driving circuit causes a fastening solenoid to engage, a method for conditioning a clock signal supplied to said circuit comprising the steps of:

determining a DC level that is a function of an input AC voltage signal, generating a clock signal having a predetermined frequency, said clock signal being output to said clock driven driving circuit, generating a firing pulse of a duration less than one-half cycle of said input AC voltage signal, said duration being determined by said frequency of said clock signal, and varying said frequency of said clock signal as a function of said DC level.

2. The method of claim 1 wherein said varying comprises the steps of:

increasing said frequency of said clock signal when said DC level decreases, and decreasing said frequency of said clock signal when said DC level increases.

3. In an electric fastening machine comprising a solenoid and a solenoid driving circuit in which said driving circuit provides a portion of a one-half cycle of an input AC voltage signal as a firing pulse, said firing pulse having a certai duration dependent upon the frequency of an input signal which is input to said driving circuit, a clock conditioning circuit comprising:

frequency generating means for generating a clock signal having a frequency, said clock signal being input to said solenoid driving circuit and said frequency determining the duration of said firing pulse, rectifying and filtering means for rectifying and filtering said AC voltage signal so as to produce a substantially DC signal, and varying means for varying the frequency of said clock signal as a function of said DC signal.

4. The apparatus of claim 3 wherein said varying means increases said frequency of said clock signal when said DC signal decreases.

5. The apparatus of claim 3 wherein said varying means decreases said frequency of said clock signal when said DC signal increases.

6. In the use of an electric fastening machine wherein a clock driven driving circuit causes a fastening solenoid to engage, a method for conditioning a clock signal supplied to said circuit comprising the steps of:

(a) determining a DC level of an input AC voltage line, (b) generating a clock signal having a predetermined frequency, said clock signal being output to said clock driven driving circuit, said generating comprising the steps of (i) comparing said DC level to a charging voltage, (ii) clamping said charging voltage to a decreased level when said charging voltage is approximately equal to said DC level, and (iii) increasing said charging voltage, and (c) varying said frequency of said clock signal when said DC level varies.

7. The method of claim 6 wherein an increase in said DC level produces a decrease in said frequency.

8. The method of claim 6 wherein a decrease in said DC level produces an increase in said frequency.

9. The method of claim 6 wherein said varying comprises the steps of:

increasing said frequency of said clock signal when said DC level decreases, and decreasing said frequency of said clock signal when said DC level increases.

10. In an electric fastening machine comprising a solenoid and a solenoid driving circuit, a clock conditioning circuit comprising:

(a) frequency generating means for generating a clock signal having a frequency, said frequency generating means comprising (i) a charging capacitor to which is applied a charging voltage, (ii) a comparator having a first input connected to said charging capacitor and a second input to which a substantially DC signal is applied, and (iii) a clamping circuit which clamps said charging voltage to a decreased level when said charging voltage is substantially equal to said DC signal, (b) rectifying and filtering means for rectifying and filtering an AC input so as to produce said DC signal, and (c) varying means for varying the frequency of said clock signal.

11. The apparatus of claim 10 wherein said varying means increases said frequency of said clock signal when said DC signal decreases.

12. The apparatus of claim 10 wherein said varying means decreases said frequency of said clock signal when said DC signal increases.

13. In the use of an electric fastening machine wherein a clock driven driving circuit causes a fastening solenoid to engage, a method for conditioning a clock signal supplied to said circuit comprising the steps of:

determining a DC level that is a function of an input AC voltage signal, generating a clock signal having a predetermined frequency, said clock signal being output to said clock driven driving circuit, generating a firing pulse of a duration less than one-half cycle of said input AC voltage signal, said duration being determined by said frequency of said clock signal, and varying said frequency of said clock signal as a function of said DC level, wherein said generating said clock signal includes the steps of comparing said DC level to a charging voltage, clamping said charging voltage to a decreased level when said charging voltage is equal to said DC level and increasing said charging voltage.

14. The method of claim 13 wherein an increase in said DC level produces a decrease in said frequency.

15. The method of claim 13 wherein a decrease in said DC level produces an increase in said frequency.

16. In an electric fastening machine comprising a solenoid and a solenoid driving circuit in which said driving circuit provides a portion of a one-half cycle of an input AC voltage signal as a firing pulse, said firing pulse having a certain duration dependent upon the frequency of an input signal which is input to said driving circuit, a clock conditioning circuit comprising:

frequency generating means for generating a clock signal having a frequency, said clock signal being input to said solenoid driving circuit and said frequency determining the duration of said firing pulse, rectifying and filtering means for rectifying and filtering said AC voltage signal so as to produce a substantially DC signal, and varying means for varying the frequency of said clock signal, wherein said frequency generating means comprises a charging capacitor to which is applied a charging voltage, a comparator having a first input connected to said charging capacitor and a second input to which said DC signal is applied, and a clamping circuit which clamps said charging voltage to a decreased level when said charging voltage is equal to said DC signal.

* * * * *